US010036181B2

(12) United States Patent
Viswanathan

(10) Patent No.: US 10,036,181 B2
(45) Date of Patent: Jul. 31, 2018

(54) HOUSEHOLD APPLIANCE HAVING A POCKET HANDLE AND ASSOCIATED DISPLAY

(71) Applicant: WHIRLPOOL CORPORATION, Benton Harbor, MI (US)

(72) Inventor: Ameresh Viswanathan, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/350,616

(22) Filed: Nov. 14, 2016

(65) Prior Publication Data

US 2018/0135333 A1 May 17, 2018

(51) Int. Cl.
*A47B 96/04* (2006.01)
*E05B 1/00* (2006.01)
(Continued)

(52) U.S. Cl.
CPC ..... *E05B 1/0084* (2013.01); *A47L 15/4257* (2013.01); *A47L 15/4293* (2013.01); *D06F 37/28* (2013.01); *D06F 39/005* (2013.01); *D06F 58/20* (2013.01); *E06B 5/00* (2013.01); *F25D 23/028* (2013.01); *F25D 29/005* (2013.01); *H05B 6/6414* (2013.01); *F25D 2400/361* (2013.01)

(58) Field of Classification Search
CPC ..... D06F 37/28; D06F 39/005; D06F 58/20; F25D 23/028; F25D 29/005; F25D 2400/361; H05B 6/6414; E05B 1/0084; E06B 5/00; A47L 15/4257; A47L 15/4293
See application file for complete search history.

(56) References Cited

U.S. PATENT DOCUMENTS 5,437,503 A * 8/1995 Baker ..... F25D 25/025 312/348.4
7,082,777 B2 * 8/2006 Becke ..... A47B 95/02 62/246
(Continued)

FOREIGN PATENT DOCUMENTS

CN 105011882 A 11/2015
DE 102015105111 A1 10/2015
(Continued)

OTHER PUBLICATIONS

Ambient Display on the Nexus 6, published Jan. 14, 2015; accessed at http://www.androidcentral.com/ambient-display-nexus-6.
(Continued)

*Primary Examiner* — Hanh V Tran
(74) *Attorney, Agent, or Firm* — McGarry Bair PC

(57) ABSTRACT

A household appliance including a cabinet defining a chamber with an access opening, a door movably mounted to the cabinet to selectively open and close the access opening and having a face, and a pocket handle having a recess provided in the door with an ingress opening to define a pocket, and a display provided with the door and overlying a portion of the pocket to define a handle pull, wherein a user can insert their fingers into the pocket through the ingress opening and pull against the handle pull to move the door to open the access opening.

19 Claims, 5 Drawing Sheets

(51) Int. Cl.

| | |
|---|---|
| ***F25D 23/02*** | (2006.01) |
| ***F25D 29/00*** | (2006.01) |
| ***D06F 37/28*** | (2006.01) |
| ***A47L 15/42*** | (2006.01) |
| ***D06F 39/00*** | (2006.01) |
| ***D06F 58/20*** | (2006.01) |
| ***H05B 6/64*** | (2006.01) |
| ***E06B 5/00*** | (2006.01) |

(56) References Cited

U.S. PATENT DOCUMENTS 7,695,572 B2* 4/2010 Ahn ..... A47L 15/0002 134/102.1
2007/0151302 A1* 7/2007 Kendall ..... D06F 29/00 68/3 R
2009/0071966 A1* 3/2009 Benz ..... F25D 25/005 220/592.01
2010/0141103 A1* 6/2010 Olesen ..... A47L 15/4257 312/228
2010/0320890 A1* 12/2010 Jung ..... F25D 27/00 312/402
2011/0192430 A1* 8/2011 Baldwin ..... E05B 17/0033 134/137
2011/0247276 A1* 10/2011 Egger ..... A47L 15/4257 49/460
2012/0111366 A1* 5/2012 Baldwin ..... A47L 15/4293 134/18
2013/0027214 A1* 1/2013 Eng ..... A47L 15/4293 340/654
2013/0113351 A1* 5/2013 Eng ..... A47L 15/4257 312/228.1
2013/0125937 A1* 5/2013 Baldwin ..... A47L 15/4293 134/56 D
2013/0234574 A1* 9/2013 Fischer ..... A47L 15/4257 312/228
2014/0000665 A1* 1/2014 Graven ..... A47L 15/46 134/58 D
2014/0145572 A1* 5/2014 Fischer ..... A47L 15/4257 312/228
2014/0319989 A1* 10/2014 Hwang ..... F25D 23/02 312/404
2015/0192288 A1* 7/2015 Kim ..... F21V 33/0044 362/253
2015/0259845 A1* 9/2015 Doyle ..... D06F 29/00 68/17 R
2017/0096837 A1* 4/2017 Criner ..... A47L 15/4257

FOREIGN PATENT DOCUMENTS

| | | | |
|---|---|---|---|
| EP | 1702551 | A1 | 9/2006 |
| EP | 2893864 | A1 | 7/2015 |
| EP | 2997873 | A2 | 3/2016 |
| EP | 3043131 | A1 | 7/2016 |
| WO | 2010069738 | A1 | 6/2010 |

OTHER PUBLICATIONS

European Search Report for Corresponding EP17199288.6 dated Jan. 11, 2018.

* cited by examiner

HOUSEHOLD APPLIANCE HAVING A POCKET HANDLE AND ASSOCIATED DISPLAY

BACKGROUND

Household appliances, examples of which can include a clothes washer, clothes dryer, an oven, a cooktop, a stove, a refrigerator, a microwave, or a dishwasher, etc., perform useful cycles of operation and often have electrical and mechanical components responsible for implementing the cycle of operation of the appliance, with one or more of the components controlling the operation of the other components. For example, a controller, such as a microprocessor-based controller, having a printed circuit board (PCB) with memory, can be used to control the operation of the various components to implement a cycle of operation. A user interface can be provided as part of or separate from the controller to provide input and output communication between a user of the appliance and the controller. A display can be provided as part of or separate from the user interface to communicate information, such as cycle status, to the user of the appliance.

BRIEF SUMMARY

In one aspect, illustrative embodiments in accordance with the present disclosure relate to a household appliance including a cabinet defining a chamber with an access opening and a door movably mounted to the cabinet to selectively open/close the access opening and having a face. A pocket handle having a recess is provided in the door with an ingress opening to define a pocket. A dead front display is provided with the door and overlying a portion of the pocket to define a handle pull, wherein a user can insert their fingers into the pocket through the ingress opening and pull against the handle pull to move the door to open the access opening.

In another aspect, illustrative embodiments in accordance with the present disclosure relate to a door assembly including a door having a face and a pocket handle having a recess provided in the door with an ingress opening to define a pocket. A dead front display is provided with the door and overlying a portion of the pocket to define a handle pull, wherein a user can insert their fingers into the pocket through the ingress opening and pull against the handle pull to move the door to open the access opening.

DETAILED DESCRIPTION

Figure 1:
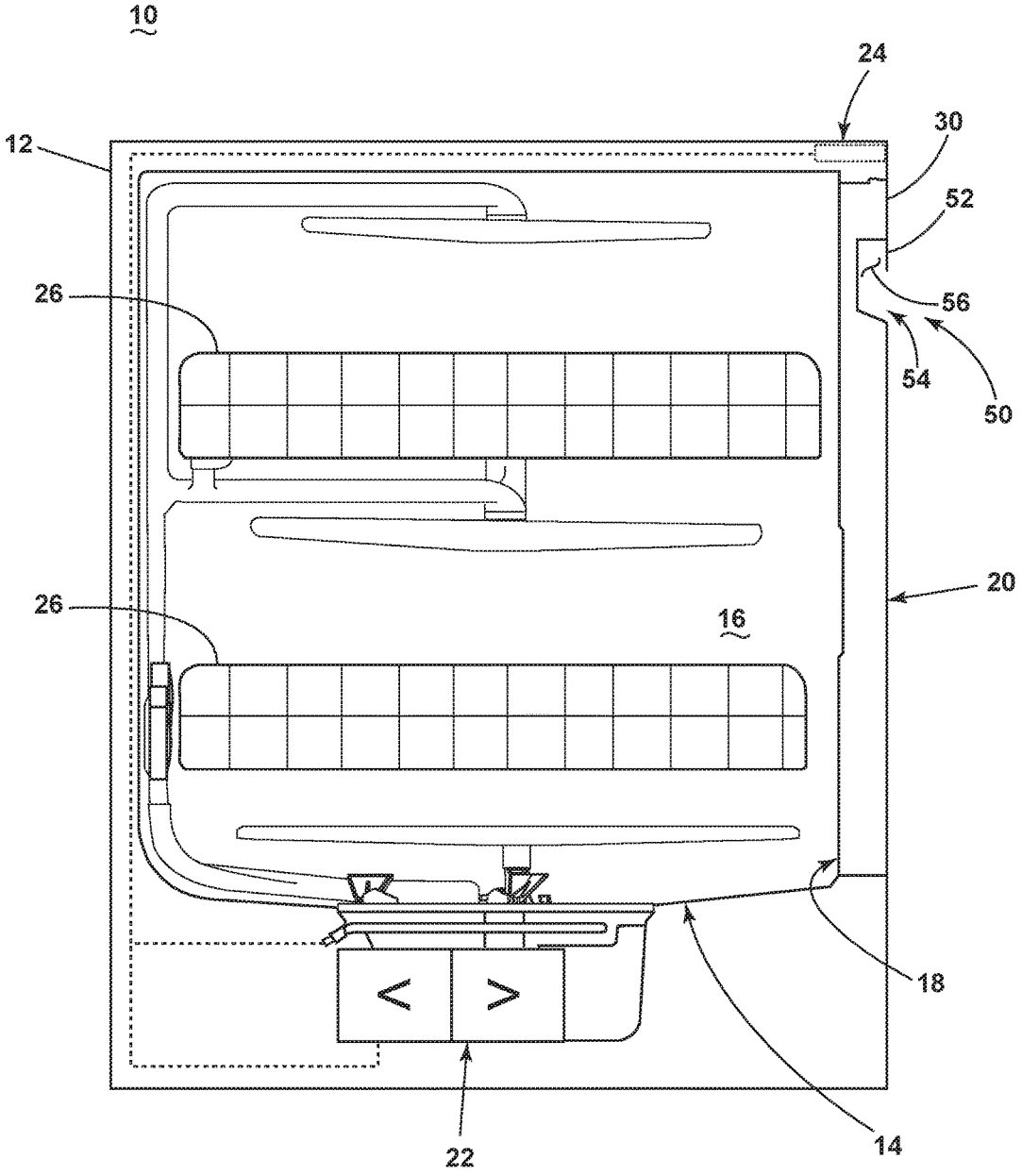
FIG. 1 is a schematic, cross-sectional view of an exemplary appliance with a door closed according to an embodiment of the invention.

FIG. 1 is a schematic illustration of a household appliance 10, illustrated herein as a dish treating appliance 10 that shares many features of a conventional automated dish treating appliance, which will not be described in detail herein except as necessary for a complete understanding of the invention. The dish treating appliance 10 can include a cabinet 12 defining an interior and an access opening of the dish treating appliance 10 and can include a frame, with or without panels mounted to the frame. A tub 14 can be provided within the cabinet 12, and can at least partially define a treating chamber 16 for receiving dishes for treatment according to the automatic cycle of operation and further include an open face defining an access opening 18 to the treating chamber 16.

A door assembly 20 can be movably mounted to the dish treating appliance 10 for movement between opened and closed positions to selectively open and close the access opening 18 of the tub 14. Thus, the door assembly 20 provides accessibility to the treating chamber 16 for the loading and unloading of dishes or other washable items. When the door assembly 20 is closed, user access to the treating chamber 16 can be prevented, whereas user access to the treating chamber 16 can be permitted when the door assembly 20 is open. The door assembly 20 can be hingedly connected with the cabinet 12 or slidingly attached to a drawer slide system to selectively provide access to the treating chamber 16.

The door assembly 20 can have a front face 30 within which a pocket handle 50 can be provided. The pocket handle 50 can be provided within a recess provided in the front face 30 of the door assembly 20. The pocket handle 50 comprises an ingress opening 54 that defines a pocket 56. The pocket 56 occupies the recess provided in the front face 30 of the door assembly 20, which can be, by way of non-limiting example, a recess formed by stamping the door assembly 20 with a recess, or by providing an opening in the door assembly 20 in which a housing defining the pocket 56 is positioned. A dead front display 58 (FIGS. 2-5) can be provided with the door assembly 20. The dead front display 58 can overlie at least a portion of the pocket 56 to define a handle pull 52. A user can insert their fingers into the pocket 56 through the ingress opening 54 and pull outwardly against the handle pull 52 in order to move the door assembly 20 away from the cabinet 12 to open the access opening 18.

It should be appreciated that the embodiments described herein apply to any household appliance that includes a door assembly 20, a pocket handle 50, and a dead front display 58, including appliances that provide heating, cooling, cleaning, drying, refreshing, compressing, cooking, and dispensing, and that include a treating chamber for receiving an article for treatment according to a cycle of operation of the household appliance. It is contemplated that the household appliance 10 can be any suitable household appliance, non-limiting examples of which include a horizontal or vertical axis washing machine; a horizontal or vertical axis automatic dryer; a combination washing machine and dryer; a tumbling or stationary refreshing/revitalizing machine; an extractor; a non-aqueous washing apparatus; a revitalizing machine, a range, an oven, a cooktop, a stove, a microwave oven, a refrigerator, a clothes freshener, a dishwasher and the like.

Additional features, such as a liquid supply and circulation system 22, including one or more liquid supply and drain conduits, sprayers and/or pumps, a control system 24 including one or more controllers and a user interface, one or more dish racks 26, and any other alternative or additional features used in a conventional automatic dish treating appliance can also be provided in the dish treating appliance 10 without deviating from the scope of the invention.

Figure 2:
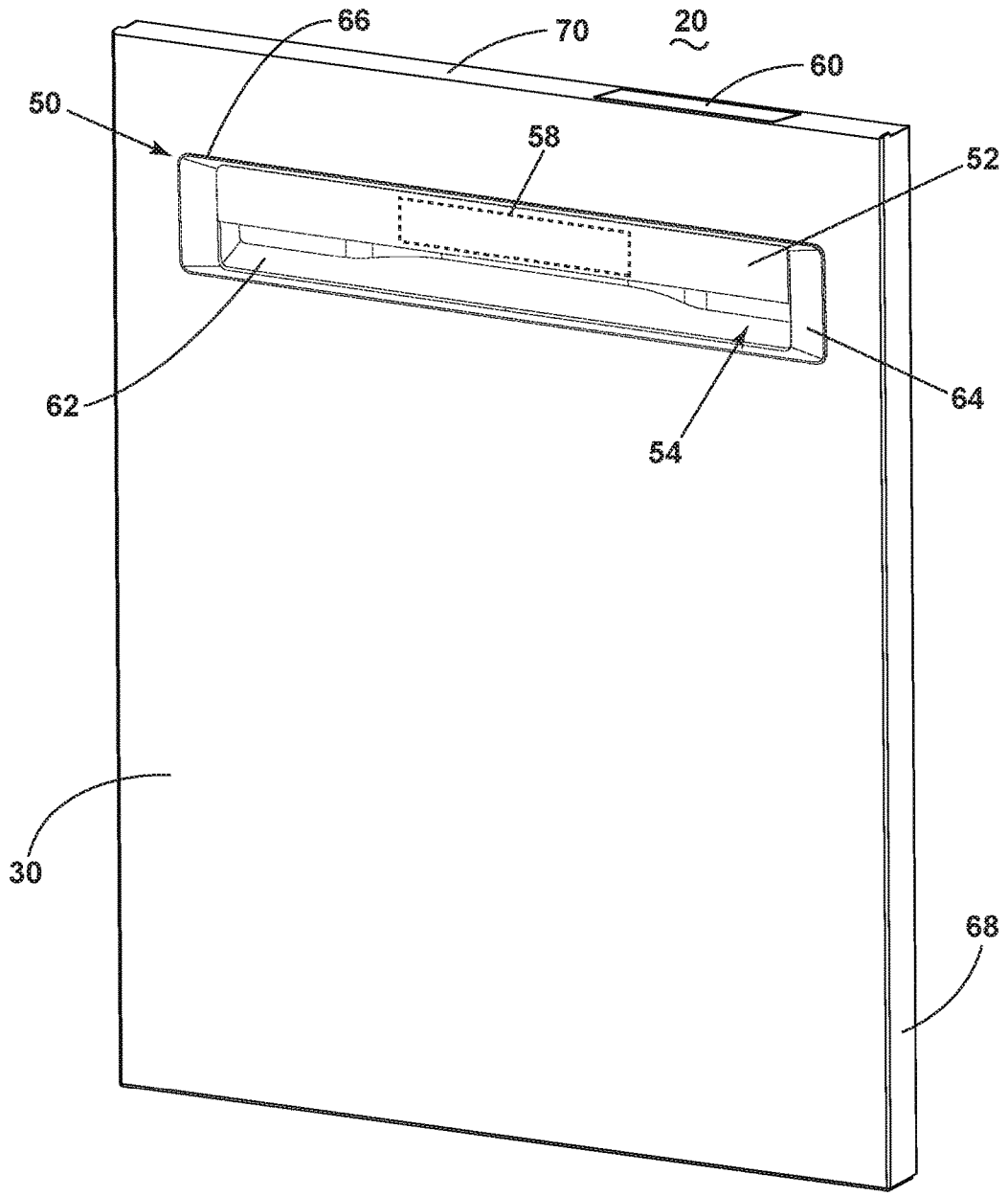
FIG. 2 is a front perspective view of a door assembly for the exemplary appliance of FIG. 1 according to an embodiment of the invention, with the door assembly having a display in an inactive condition.

Referring now to FIG. 2, a front perspective view of the door assembly 20 is illustrated in which the dead front display 58 is shown in an inactive condition. When the dead front display 58 is in the inactive condition, no information or lighting is shown on the dead front display 58 and the dead front display 58 is visually indistinguishable from the surrounding handle pull 52. The pocket handle 50 is received within a face opening 66 within the front face 30 of the door assembly 20. The face opening 66 is generally aligned with the ingress opening 54. The pocket handle 50 optionally further includes a trim bezel 64 that angles inwardly into the space behind the front face 30 of the door assembly 20. Because the trim bezel 64 angles behind the front face 30 of the door assembly 20, the pocket 56, the ingress opening 54, and the dead front display 58 are located interiorly of the door assembly 20, in particular interiorly of the front face 30 of the door assembly 20. The trim bezel 64 extends between the face opening 66 and the ingress opening 54. The rear limit of the ingress opening 54 is defined by an angled rear surface 62 of the pocket 56.

While the dead front display 58 is illustrated herein as overlying only a portion of the ingress opening 54 and the handle pull 52, it will be understood that the dead front display 58 can overlie the ingress opening 54 and the handle pull 52 in any suitable portion. In an exemplary embodiment, it is contemplated that the dead front display 58 can overlie more than half of the ingress opening 54. The remaining portion of the ingress opening 54 over which the dead front display 58 and handle pull 52 do not overlie forms the access opening through which a user can insert at least a portion of their fingers to grip the rear face of the handle pull 52 and pull the door assembly 20 to an opened condition. Further, it will be understood that the dead front display 58 can comprise the entire horizontal and/or vertical width of the handle pull 52.

In an exemplary embodiment, the dead front display 58 is a molded plastic piece, but it will be understood that any suitable material can be used. The dead front display 58 can have a variety of difference surface finishes or treatments in order to match the visual profile of the door assembly 20 and to aid in the visual indistinguishability of the dead front display 58 from the surrounding materials. The trim bezel 64 can be formed of, by way of non-limiting example, a stamped metal substrate or of molded plastic. The trim bezel 64 can also have a variety of difference surface finishes or treatments, such as, by way of non-limiting example, electro-plating, matte finish, gloss finish, mirrored finish, metallic finish, or chrome finishing. The dead front display 58 and the trim bezel 64 can have the same color and finish as one another, or they can have differing colors and finishes from one another. In an exemplary embodiment, both the dead front display 58 and the angled rear surface 62 of the pocket 56 can be black in color.

The door assembly 20 can be further provided with a user interface 60. The user interface 60 can have at least one input by which a user can input a selection or an instruction to the dish treating appliance 10. The user interface 60 can have a plurality of user inputs, which can be provided in the form of buttons. By way of non-limiting example, the buttons can be provided as capacitive touch buttons in an exemplary embodiment. In an exemplary embodiment, the user interface 60 can be located on a portion of the door assembly 20 other than the front face 30. Non-limiting examples of such a location include on a top edge 70 or on a side edge 68 of the door assembly 20. However, it will also be understood that the user interface 60 can be included within the dead front display 58 or on the angled rear surface 62 of the pocket 56. It is further contemplated that, independent of the location of the user interface 60 for receiving user input, status displays in addition to those shown on the dead front display 58 can also be displayed on the angled rear surface 62 of the pocket 56. Status displays on the angled rear surface 62 of the pocket 56 can include, by way of non-limiting example, status information that is projected onto the angled rear surface 62 of the pocket 56.

Figure 3:
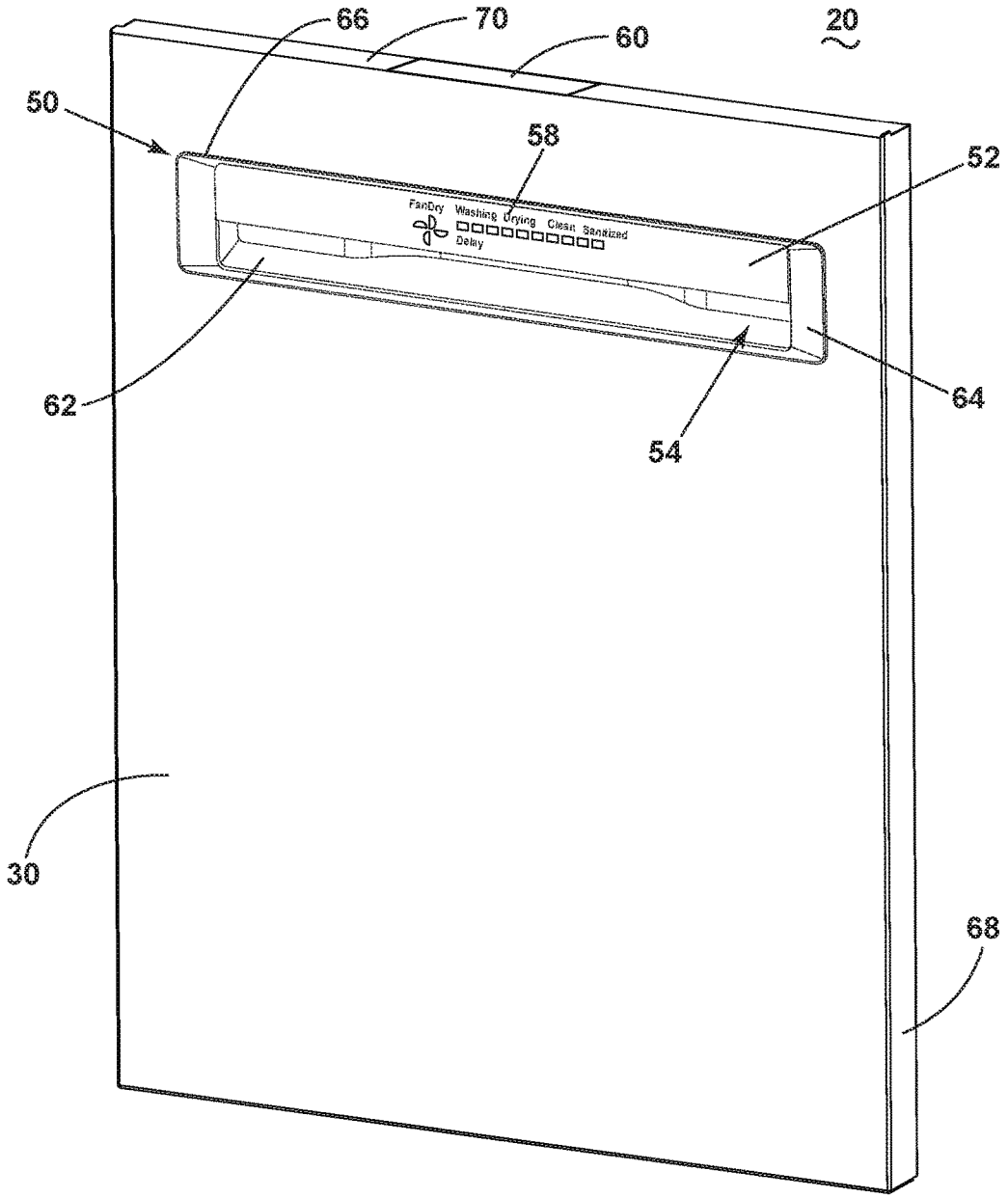
FIG. 3 is a front perspective view of the door assembly of FIG. 2 according to an embodiment of the invention, with the door assembly having a display in an activated condition.

Referring now to FIG. 3, a front perspective view of the door assembly 20 is illustrated in which the dead front display 58 is shown in an activated condition. When the dead front display 58 is activated, a status display or indicator is visible through the dead front display 58. Even when a status or indicator is displayed on the dead front display 58, there is still no visible demarcation of the boundaries of the dead front display 58. Rather, the appearance is given that the status information is appearing on the handle pull 52 without the need for or use of a dedicated and visually defined display panel. When the status information ceases to be displayed, the dead front display 58 again returns to the previous "dead" or inactive condition in which there is no visual indication that the dead front display 58 is present on the handle pull 52.

Figure 4:
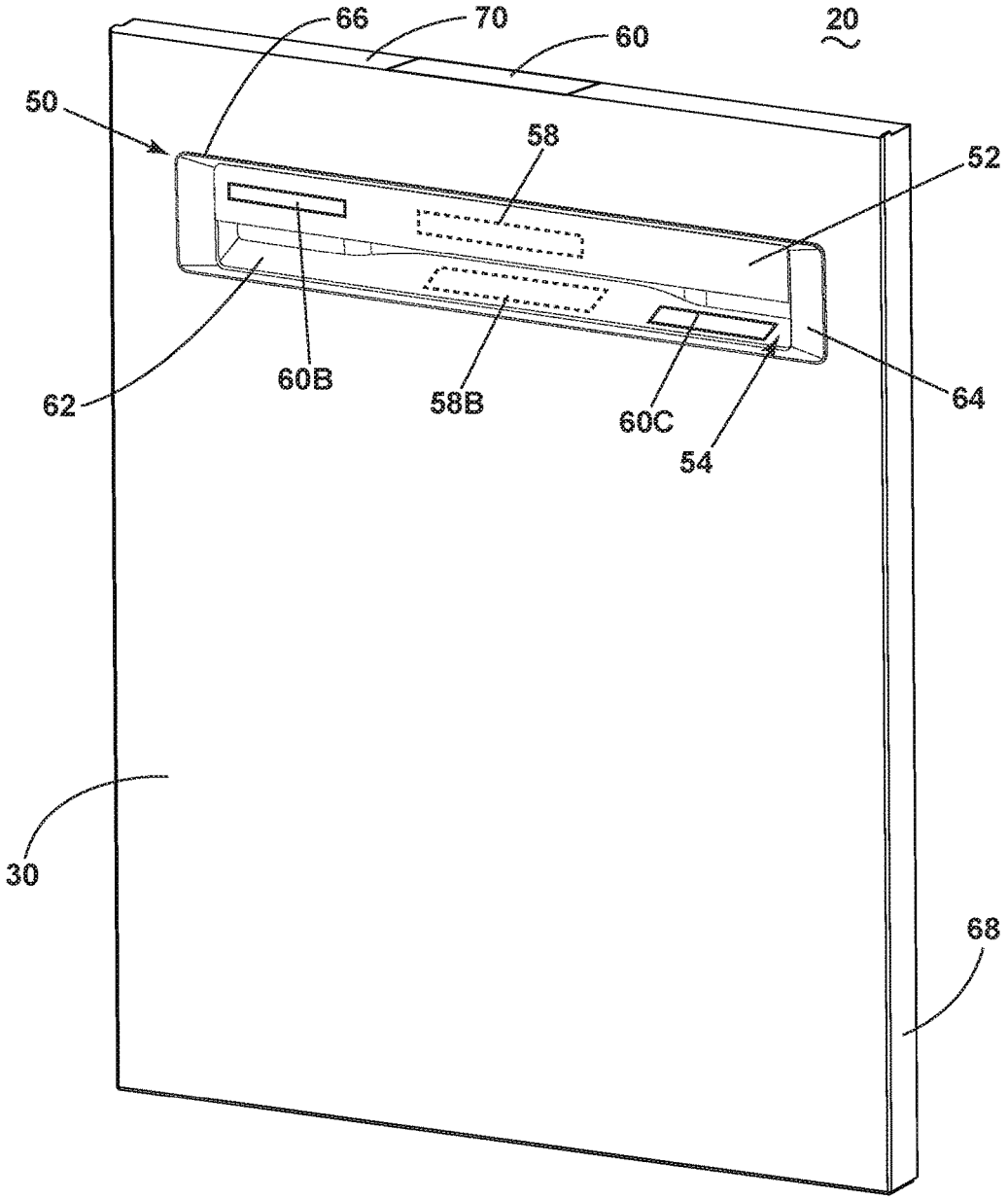
FIG. 4 is a front perspective view of the door assembly of FIG. 2 according to an embodiment of the invention, illustrating contemplated alternate locations for a display or a user interface.

Referring now to FIG. 4, the door assembly 20 of FIG. 2 is shown with non-limiting examples of alternate locations in which the dead front display 58 and/or the user interface 60 can be located within the door assembly 20. As described previously, the dead front display 58 can alternately be located on the angled rear surface 62 of the pocket 56, as schematically shown by the dashed outline 58B. As further described previously, the user interface 60 can alternately be located within the dead front display 58 and handle pull 52 portions of the pocket handle 50, as indicated by the schematic outline 60B. It is also contemplated that the user interface 60 can be located on the angled rear surface 62 of the pocket 56, as shown by the schematic outline 60C. It will be understood that it is within the scope of the disclosure that any of the disclosed alternate locations for one of the dead front display 58 or the user interface 60 can be combined with any of the disclosed alternate locations for the other of the dead front display 58 or the user interface 60 in any possible combination.

Figure 5:
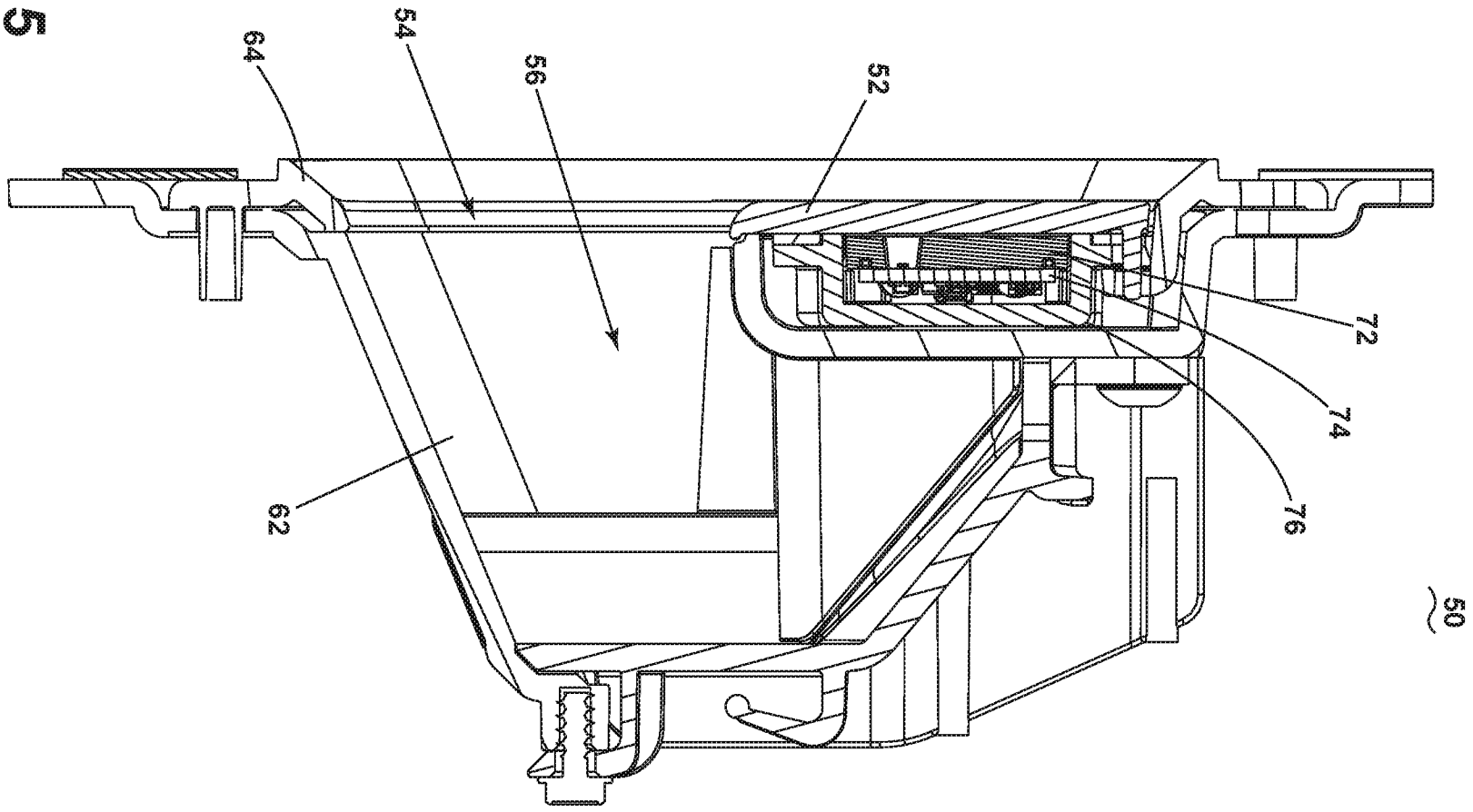
FIG. 5 is a schematic, cross-sectional side view of a pocket handle for use in the door assembly of FIG. 2 according to an embodiment of the invention.

Referring now to FIG. 5, a schematic, side cross-sectional view of the pocket handle 50 is illustrated. In this view the components making up the dead front display 58 portion of the pocket handle 50 can be seen. A display screen 72 is positioned against the rear of the handle pull 52. Behind the display screen 72 is a light source 74. The light source 74 is configured to provide light to the display screen 72 and may include light-emitting diodes (LEDs) or alternative light emitting devices. The display screen 72 and the light source 74 are contained against the handle pull 52 by a display housing 76. The light source 74 will be operably coupled with the control system 24 of the dish treating appliance 10.

The above described embodiments provide a dead front display that can be used within a pocket handle for a variety of household appliances. The dead front display and pocket handle as described herein provide a variety of benefits, including improved visual appearance to the user of the household appliance. Rather than having a visually distinguishable display panel, the dead front display appears to be seamlessly integrated into the trim features of the handle, such that when the display is inactive, it is not visually apparent that a display area is present. In this way, the front face of the household appliance and of the pocket handle portion can have a sleek and uninterrupted visual appearance. In addition, the dead front display can have the user interface integrated with it, or the user interface can be located remotely from the dead front display, providing great freedom for design and manufacturing constraints for a variety of different household appliances that can make use of the embodiments described herein.

To the extent not already described, the different features and structures of the various embodiments of the invention may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A household appliance comprising:

a cabinet defining a chamber with an access opening;

a door movably mounted to the cabinet to selectively open and close the access opening, the door having a face;

a pocket handle having a recess having a first length provided in the door with an ingress opening to define a pocket; and a display provided with the door and having a second length that is longer than the first length, the display comprising a dead front display configured to display information to a user, the display overlying a portion of the pocket to define a non-rotatable handle pull for the pocket and wherein when the dead front display is in an inactive condition no information or lighting is shown on the dead front display and the dead front display is visually indistinguishable from a remainder of the non-rotatable handle pull;

wherein a user can insert their fingers into the pocket through the ingress opening and pull against a rear surface of the non-rotatable handle pull to move the door to open the access opening.

2. The household appliance of claim 1 wherein the pocket, ingress opening, and dead front display are located interiorly of the door.

3. The household appliance of claim 2 wherein the face comprises a face opening aligned with the ingress opening.

4. The household appliance of claim 3 further comprising a trim bezel extending between the face opening and the ingress opening.

5. The household appliance of claim 4 wherein the dead front display overlies more than half of the ingress opening.

6. The household appliance of claim 5 wherein both the dead front display and the pocket are black in color.

7. The household appliance of claim 6 further comprising a user interface having at least one input located on a portion of the door other than the face.

8. The household appliance of claim 7 wherein the door further comprises a side edge and the user interface is located on the side edge.

9. The household appliance of claim 8 wherein the chamber is a treating chamber that receives an article for treatment according to a cycle of operation for the household appliance.

10. The household appliance of claim 9 wherein the household appliance is one of a dishwasher, clothes washer, clothes dryer, refrigerator, stove, oven, or microwave.

11. The household appliance of claim 1 wherein the dead front display overlies more than half of the ingress opening.

12. The household appliance of claim 1 wherein both the dead front display and the pocket are black in color.

13. The household appliance of claim 1 further comprising a user interface having at least one input located on a portion of the door other than the face.

14. The household appliance of claim 13 wherein the door further comprises a side edge and the user interface is located on the side edge.

15. The household appliance of claim 1 wherein the household appliance is one of a dishwasher, clothes washer, clothes dryer, refrigerator, stove, oven, or microwave.

16. A door assembly comprising:

a door having a face; and a pocket defining a recess in the door, the pocket having an ingress opening; and a display comprising a dead front display configured to display information to a user, the display overlying a portion of the pocket to define a non-rotatable handle pull having a rear face; and a user interface having at least one input located on a portion of the door other than the face;

wherein a user can insert their fingers into the pocket through the ingress opening and pull against the rear face of the non-rotatable handle pull to move the door to open an access opening and wherein there is no visible demarcation of boundaries of the dead front display and wherein when the dead front display is in an inactive condition no information or lightning is shown on the dead front display.

17. The door assembly of claim 16 wherein the dead front display overlies more than half of the ingress opening.

18. The door assembly of claim 16 wherein both the dead front display and the pocket are black in color.

19. The door assembly of claim 16 wherein the door further comprises a side edge and the user interface is located on the side edge.

* * * * *